US005138966A

United States Patent [19]

Whitley, II

[11] Patent Number: 5,138,966

[45] Date of Patent: Aug. 18, 1992

[54] HYDROFOIL FOR MARINE OUTBOARD ENGINE/MARINE OUTDRIVE

[75] Inventor: Warwick M. Whitley, II, Lynn Haven, Fla.

[73] Assignee: Attwood Corporation, Lowell, Mich.

[21] Appl. No.: 654,840

[22] Filed: Feb. 12, 1991

[51] Int. Cl.[5] ..... B63H 21/26

[52] U.S. Cl. ..... 114/274; 440/66; 440/900

[58] Field of Search ..... 114/271, 274, 283, 288; 440/49, 66, 900, 76, 78; D12/309

[56] References Cited

U.S. PATENT DOCUMENTS

| | | | |
|---|---|---|---|
| 1,226,400 | 5/1917 | Smith | 114/274 |
| 2,319,640 | 5/1943 | Sink | 440/71 |
| 2,705,468 | 4/1955 | Dix | 440/900 |
| 2,791,196 | 5/1957 | Strang | 114/274 |
| 2,955,559 | 10/1960 | Palmer et al. | 114/274 |
| 2,963,000 | 12/1960 | Fester | 440/71 |
| 2,998,795 | 9/1961 | Downie et al. | 114/145 R |
| 3,099,240 | 7/1963 | Montague, Jr. | 114/274 |
| 3,114,343 | 12/1963 | Headrick et al. | 114/274 |
| 3,139,853 | 7/1964 | McCarthy et al. | 114/274 |
| 3,185,120 | 5/1965 | Bader | 114/274 |
| 3,211,119 | 10/1965 | Kiekhaefer | 114/274 |
| 3,343,512 | 9/1967 | Rasmussen | 114/274 |
| 3,433,195 | 3/1969 | Poole | 114/274 |
| 4,205,618 | 6/1980 | Olsson | 114/281 |
| 4,445,452 | 5/1984 | Loch | 114/282 |
| 4,487,152 | 12/1984 | Larson | 114/274 |
| 4,708,672 | 11/1987 | Bentz | 440/66 |
| 4,738,644 | 4/1988 | Happel | 440/900 |
| 4,744,779 | 5/1988 | Koehler | 440/900 |
| 4,756,265 | 7/1988 | Lane | 114/57 |
| 4,781,632 | 11/1988 | Litjens | 440/66 |
| 4,781,634 | 11/1988 | Harris | 440/66 |
| 4,875,882 | 10/1989 | Plitt | 440/66 |
| 4,895,493 | 1/1990 | Dalsbo | 440/66 |
| 4,968,275 | 11/1990 | Carlson | 440/66 |
| 4,995,840 | 2/1991 | Seale et al. | 440/66 |
| 5,047,869 | 4/1991 | Zoellner | 440/66 |

FOREIGN PATENT DOCUMENTS

| | | |
|---|---|---|
| 103245 | 6/1936 | Australia . |
| 275818 | 12/1964 | Australia . |
| 716879 | 10/1954 | United Kingdom . |
| 738333 | 10/1955 | United Kingdom . |
| 992375 | 5/1965 | United Kingdom . |
| 994320 | 6/1965 | United Kingdom . |
| 1369710 | 10/1974 | United Kingdom . |

*Primary Examiner*—Joseph F. Peters, Jr.
*Assistant Examiner*—Clifford T. Bartz
*Attorney, Agent, or Firm*—Prince, Heneveld, Cooper, DeWitt & Litton

[57] ABSTRACT

A hydrofoil for mounting on the lower unit of a marine outboard engine/marine outdrive which improves the performance and stability of a boat driven by the lower unit. Each hydrofoil includes an upwardly angled wing segment and a wingtip fin at the outer end of the wing segment. The hydrofoils are preferably mounted in a pair on the lower unit and form a V-shaped assembly. Alternately, the hydrofoils may be formed as a single unit in which they are joined near their trailing edges. When mounted on the lower unit on a boat with a V-shaped hull bottom, the hydrofoil assembly generally matches the hull bottom shape to lower drag and water resistance during operation and to prevent interference with the forks of a fork lift truck when the boat is lifted.

47 Claims, 7 Drawing Sheets

HYDROFOIL FOR MARINE OUTBOARD ENGINE/MARINE OUTDRIVE

BACKGROUND OF THE INVENTION

This invention relates to hydrofoils for boats and, more particularly, to a hydrofoil adapted for attachment to the lower unit of a marine outboard engine or marine outdrive, which increases the stability of a boat driven at higher speeds by the lower unit including such assembly while improving the acceleration performance of the boat.

Marine hydrofoils are commonly used on boats and ships to increase performance and especially to allow operation at high speeds. Typical arrangements include combinations of bow and stern hydrofoils which act as struts to lift the main hull of the boat or ship from the water as power is increased thereby allowing operation at significantly higher speeds.

More recently, the use of stabilizer fins at the rear of smaller boats such as sport runabouts or high speed fishing boats known as "bass boats" have become popular. Exemplary of such structures which are added to alter the high speed running attitude of the associated boats are Kohler U.S. Pat. No. 4,744,779, Happel U.S. Pat. No. 4,738,644, Larson U.S. Pat. No. 4,487,152 and Loch U.S. Pat. No. 4,445,452. Each of these patents discloses stabilizing fins or hydrofoils extending generally horizontally outwardly or downwardly from either side of a propulsion unit at the rear of a small craft. Such stabilizers are intended to help force the bow of the boat downwardly during acceleration to improve visibility and reduce "porpoising" of the boat at higher speeds thereby providing more stability. However, in use, various drawbacks with these prior known stabilizers have been revealed.

First, since prior stabilizers have been positioned immediately adjacent the propeller on the propulsion unit, they have tended to reduce boat speed at both normal crusing and high power settings because of the inherent drag caused by continued contact with the water by the substantially horizontally extending elements. Secondly, these stabilizers have often struck obstructions at or slightly below the surface of the water causing damage not only to the stabilizers themselves but also to the propulsion unit. For example, should a boat including the prior stabilizers run up on a sand bar unexpectedly, the stabilizers will dig in and break or dismember the lower unit. In some cases, such stabilizers have also induced forwardly extending spray over the transom of the craft at certain trim angles causing discomfort to the occupants or the boat. Further, since modern day small craft often include V-shaped hull bottoms and are often lifted from the water at marinas using elongated fork lifts for storage in vertically stacked arrangements, such horizontally extending fins have tended to obstruct access to the rear of the boat and the hull with fork lifts making launching and retrieval difficult.

The present invention was conceived to provide improved performance and overcome such operational drawbacks encountered with prior known stabilizers for smaller watercraft.

SUMMARY OF THE INVENTION

Accordingly, the present invention provides a hydrofoil for mounting on the lower unit of a marine outboard engine/marine outdrive which both improves the acceleration performance and the stability of a boat driven by the lower unit including the invention. The hydrofoils are preferably mounted in pairs on the lower unit and form a V-shaped assembly, each hydrofoil including an upwardly angled wing segment and a wingtip fin at the outer end of that wing segment. Alternately, the hydrofoils may be formed as a single unit with the wing segments joined near their trailing edges. When mounted on the lower unit on a boat with a V-shaped hull bottom, the hydrofoil assembly generally matches the hull bottom shape to reduce drag and water resistance at normal cruising and high speeds, and to prevent interference with the forks of a fork lift truck when the boat is lifted or launched.

In one form, the invention is a hydrofoil assembly for marine engines comprising a pair of hydrofoils, each hydrofoil including an upwardly angled wing segment having top and bottom surfaces and inner and outer ends. A wingtip fin extends downwardly from the outer end of each wing segment. Mounting means are provided for attaching each hydrofoil to an edge of an outwardly extending plate on the lower unit of a marine outboard engine/marine outdrive. When mounted on a lower unit in a pair, the hydrofoils extend generally laterally outwardly in opposition to one another and generally transverse to the fore and aft line of the lower unit. Each hydrofoil defines a positive, upward dihedral angle with the lower unit plate thereby providing a shallow V-shape for the assembly when so mounted.

In other aspects, each hydrofoil wing segment includes a swept back leading edge, a positive camber, a rounded leading edge and a blunt trailing edge. The bottom surface of each of the wing segments adjacent the trailing edge extends downwardly at an angle to the remainder of the bottom surface in order to help increase lift, especially at lower power settings and boat speeds. The wing segments are preferably tapered toward their outer ends with a wingtip fin preferably extending for the full length of the tip. The wingtip fins preferably include a rounded leading edge curving toward the bottom. Also, each wing segment preferably extends upwardly at a dihedral angle within the range of between about 15° and 25° with respect to its root segment.

Alternately, the wing segments may be joined together as a unit by a connecting segment such that a pair of hydrofoils is in spaced relationship.

In yet other aspects of the invention, the hydrofoils are adapted for use with boats having generally V-shaped hull bottoms extending forwardly from their transoms. When mounted on the lower unit of a marine outboard engine/marine outdrive on the transom of such a boat to project laterally outwardly from the lower unit, tne upwardly angled hydrofoils form a V-shape generally matching the V-shape of the hull bottom. Such shape generally matches the V-shaped water groove in the wake behind such boats whereby drag and water resistance at higher speeds is reduced. Moreover, because of such V-shape, the forks of a fork lift truck which is useful to lift the boat during launching and retrieval may engage the hull bottom from the rear without interference from the hydrofoils.

In use, the hydrofoil assembly of the present invention provides reduced drag and higher watercraft speeds at high power and/or at cruising and "on plane" power settings. In addition, the acceleration performance of boats including such hydrofoils is increased.

The bow of such boats is brought down rapidly with the use of this invention such that full plane attitude is obtained rapidly to provide improved driver visibility and safety. At cruising and high speeds, the hydrofoils of the present invention have less wetted surface causing reduced drag because they generally match the shape of the water groove in the wake behind the boat. During acceleration, torque roll under the application of power is reduced. The down turned trailing edge on the lower or pressure surface of tne hydrofoils increases camber and lift, especially at normal and low trim angles, at lower speeds, and during acceleration. The wingtip fins act to gather water and force the water under and along the pressure surface on the underside of the hydrofoils to further enhance lift, especially at lower trim angles. In addition, spray over the transom at various trim angles is reduced as compared to prior known stabilizers, while the upward angle of the hydrofoils more effectively avoids obstructions in the water such as sand bars and allows use of fork lifts without interference for launching and retrieval of craft incorporating the hydrofoils.

These and other objects, advantages, purposes and features of the invention will become more apparent from a study of the following description taken in conjunction with the drawings.

DESCRIPTION OF THE PREFERRED EMBODIMENTS

Figure 1:
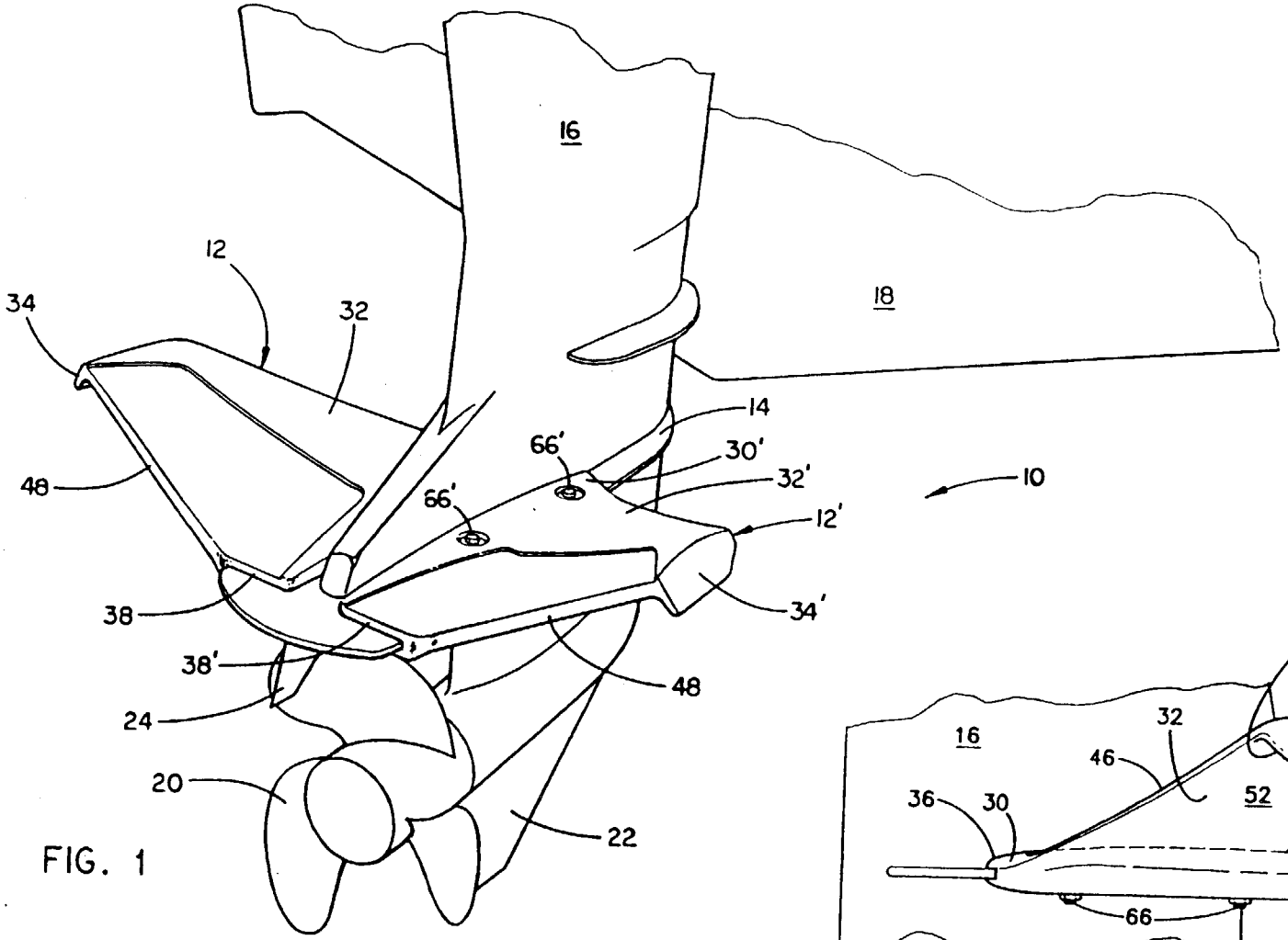
FIG. 1 is a perspective view of a first embodiment of the hydrofoil of the present invention mounted in a pair as an assembly on the lower unit of a marine outboard engine or marine outdrive.
Figure 2:
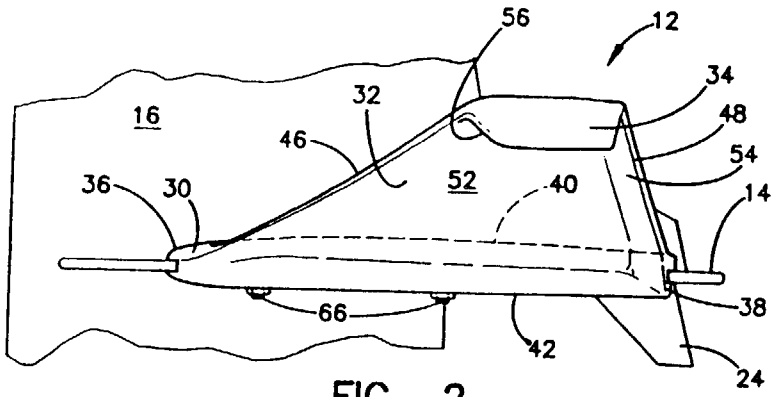
FIG. 2 is a side elevation of the hydrofoil assembly on the lower unit shown in FIG. 1.
Figure 4:
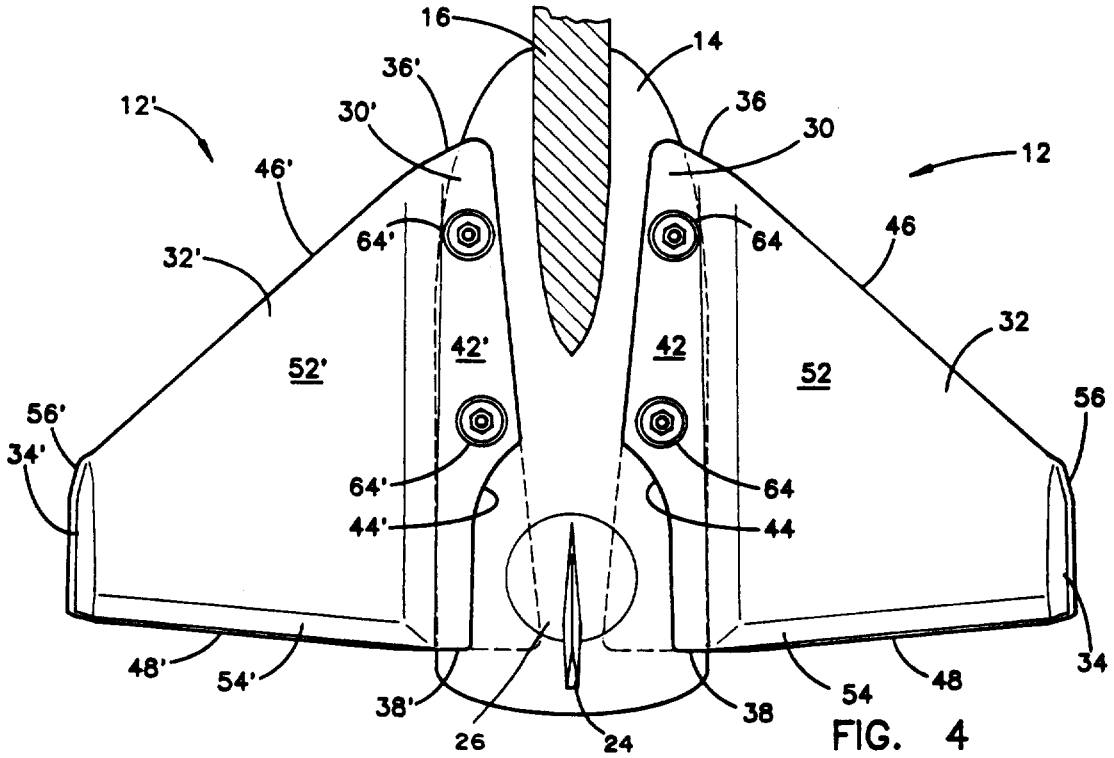
FIG. 4 is a bottom plan view of the hydrofoil assembly on the lower unit shown in FIGS. 1-3.

Referring now to the drawings in greater detail, FIG. 1 shows a first embodiment 10 of a hydrofoil assembly including a pair of separate hydrofoils 12, 12' which are mirror images of one another and adapted to be mounted on opposite sides of the outwardly extending, generally horizontal anticavitation plate 14 of a conventional lower unit 16 of a marine outboard engine or marine outdrive of an inboard/outboard propulsion unit for smaller water craft such as that shown at 18. As is well known, the anticavitation plate 14 is positioned immediately above the rearwardly directed propeller 20 which is above the bottom skeg or fin 22 of the lower unit. Typically, lower unit 16 will also include a downwardly extending stabilizer fin 24 mounted on a circular projection 26 on the underside of the aft end of anticavitation plate 14 as shown in FIGS. 1, 2 and 4. For convenience, only one of the two substantially mirror image hydrofoils 12, 12' will be described below although like prime numerals will indicate like parts on tne other hydrofoil 12'.

As is best seen in FIGS. 1-4, each hydrofoil 12 12' is preferably molded from a generally rigid, resinous material such as polypropylene and includes an elongated root segment 30, a wing segment 32, and a wingtip fin 34 or the outer end of the wing segment. Each root segment 30 extends generally horizontally, has a rounded leading edge 36 which is swept back preferably at an angle of approximately 27°, and a blunt trailing edge 38. The upper or suction surface 40 of the root segment is convex providing a positive camber for the segment while the bottom surface 42 is substantially planar. In addition, the rear portion of the lower surface 42 of root segment 40 is cut away at 44 to provide clearance for the rounded projection 26 on the bottom surface of plate 14.

Figure 7:
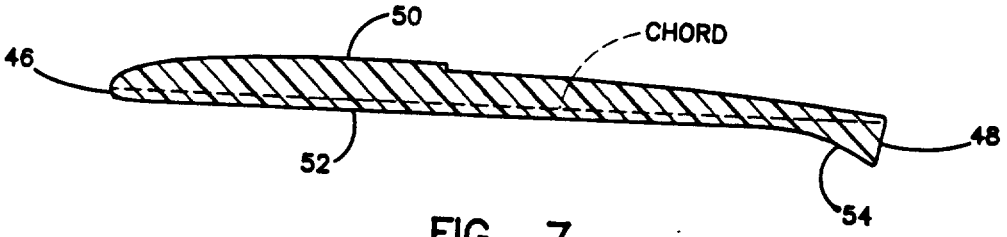
FIG. 7 is a section of the wing segment of one portion of the hydrofoil assembly taken along plane VII—VII of FIG. 6.

Wing segment 32 also includes a rounded leading edge 46 (FIG. 7) which is preferably swept back at an angle greater than the angle of leading edge 36 of root segment 30, i.e., preferably at an angle within the range of between about 32° and 34°, as well as a blunt trailing edge 48. The upper or suction surface 50 of wing segment 32 is also convex to provide a positive camber for increased lift especially at lower speeds while the bottom surface 52 is generally planar except for the area 54 adjacent trailing edge 48 which extends at a downward angle with respect to the remainder of the lower surface. Downturned trailing area 54 provides a positive camber for the lower surface and helps to increase lift as is best seen in FIGS. 2 and 7.

Figure 3:
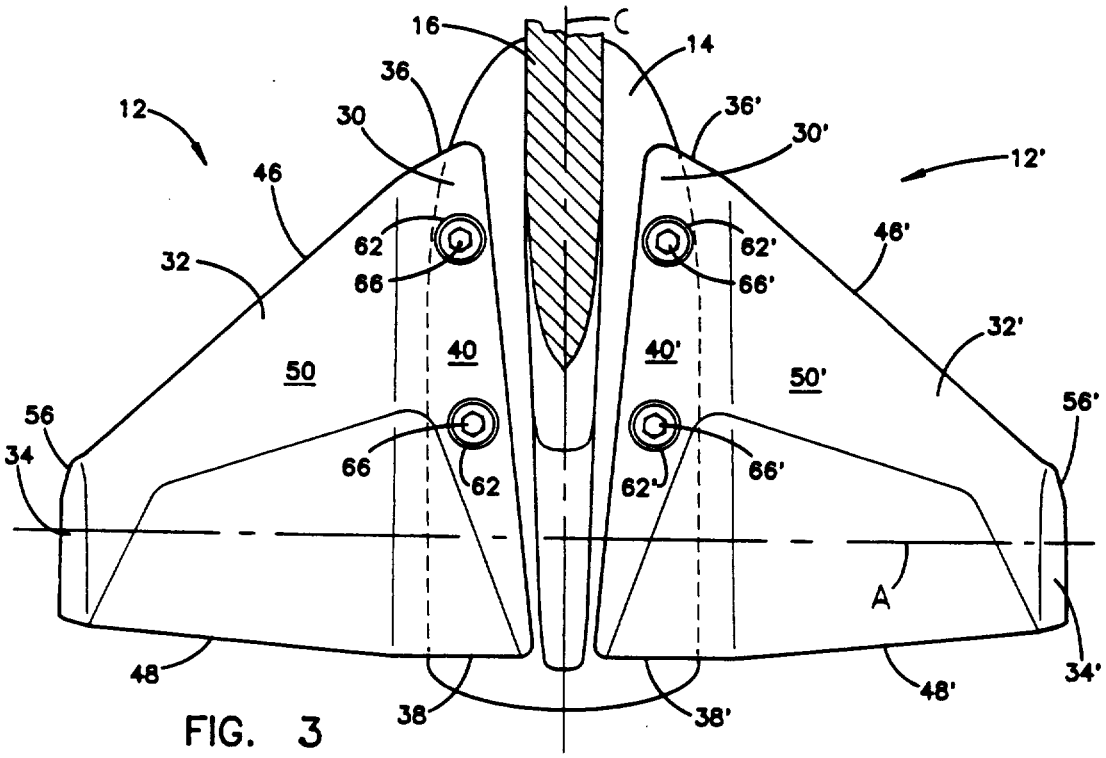
FIG. 3 is a top plan view of the hydrofoil assembly on the lower unit shown in FIGS. 1 and 2.

As shown in FIGS. 3 and 4, the leading and trailing edges 46, 48 of each wing segment converge toward the outer ends such that the wing segments are outwardly tapered. Wingtip fin 34 is joined to the outer end of the outer section of the wing segment and extends generally perpendicular to the line A (FIG. 3) extending in the spanwise direction of the hydrofoil through each of the cords of the hydrofoil sections and is generally parallel to the cord of the innermost section of the wing segment. When mounted on plate 14, this spanwise line A in each wing segment is generally perpendicular to the fore and aft centerline C of the lower unit such that the wingtip fin is generally parallel to that centerline. Wingtip fin 34 itself is substantially planar and includes a rounded leading edge 56 which curves downwardly and rearwardly to the lower edge of the wingtip fin as shown in FIG. 2. Thus, the wingtip fin extends along substantially the full length of its wing segment outer end.

Figure 5:
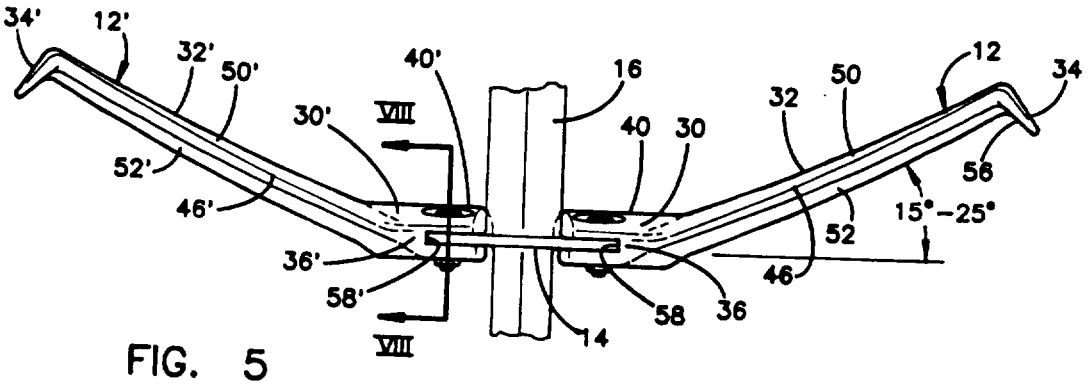
FIG. 5 is a front elevation of the hydrofoil assembly on the lower unit shown in FIGS. 1-4.
Figure 6:
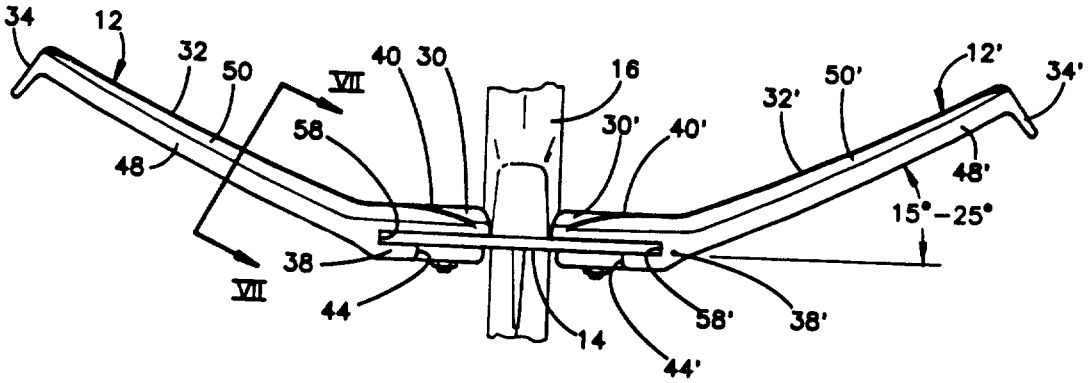
FIG. 6 is a rear elevation of the hydrofoil assembly shown in FIGS. 1-5.

With reference to FIGS. 5 and 6, each wing segment extends upwardly with respect to the substantially horizontal root segment at a dihedral angle within the range of between 15° and 25°, preferably 21 . When mounted on plate 14 of lower unit 16 as shown in FIGS. 5 and 6, the hydrofoils form an assembly 10 having the shape of a shallow V.

Figure 8:
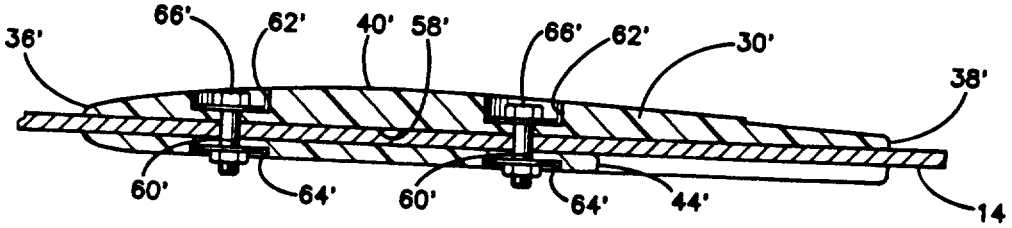
FIG. 8 is a section of the root segment of one portion of the hydrofoil assembly taken along plane VIII—VIII of FIG. 5 and showing the attachment of the hydrofoil to the lower unit.
Figure 9:
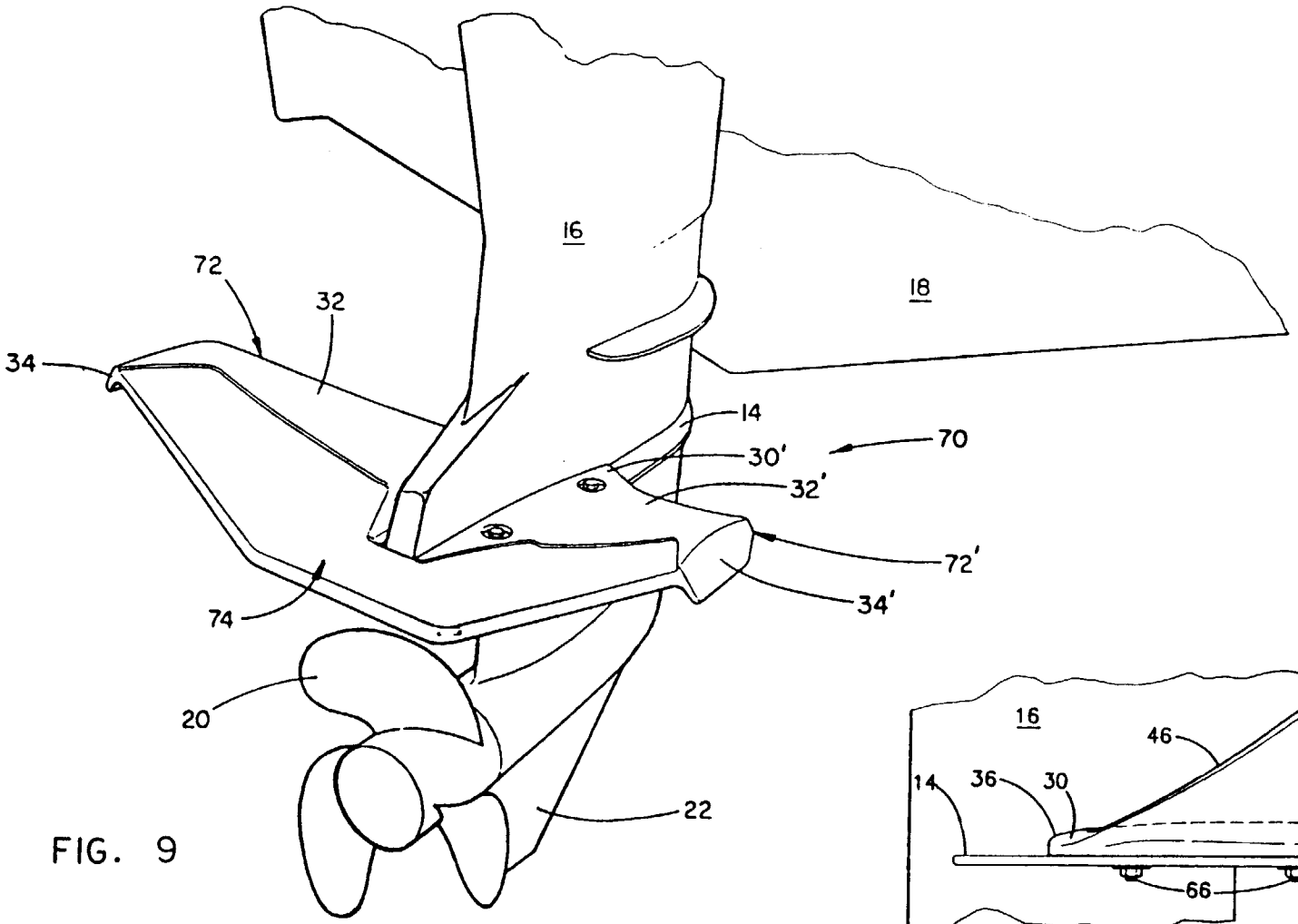
FIG. 9 is a perspective view of a second embodiment of the hydrofoil of the present invention mounted as an assembly on the lower unit of a marine outboard engine/marine outdrive.
Figure 10:
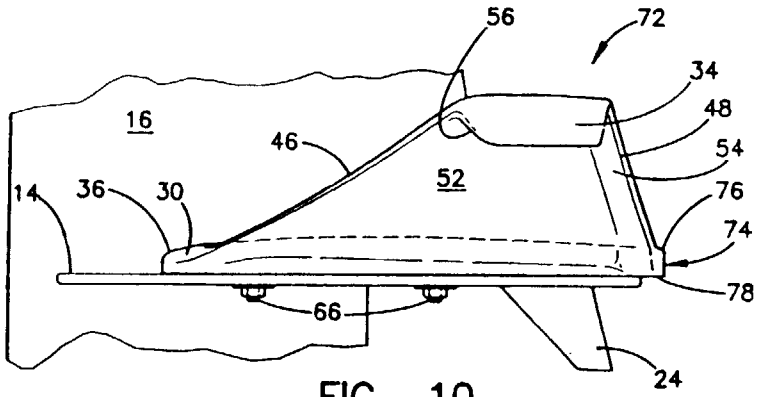
FIG. 10 is a side elevation of the hydrofoil assembly of FIG. 9.
Figure 11:
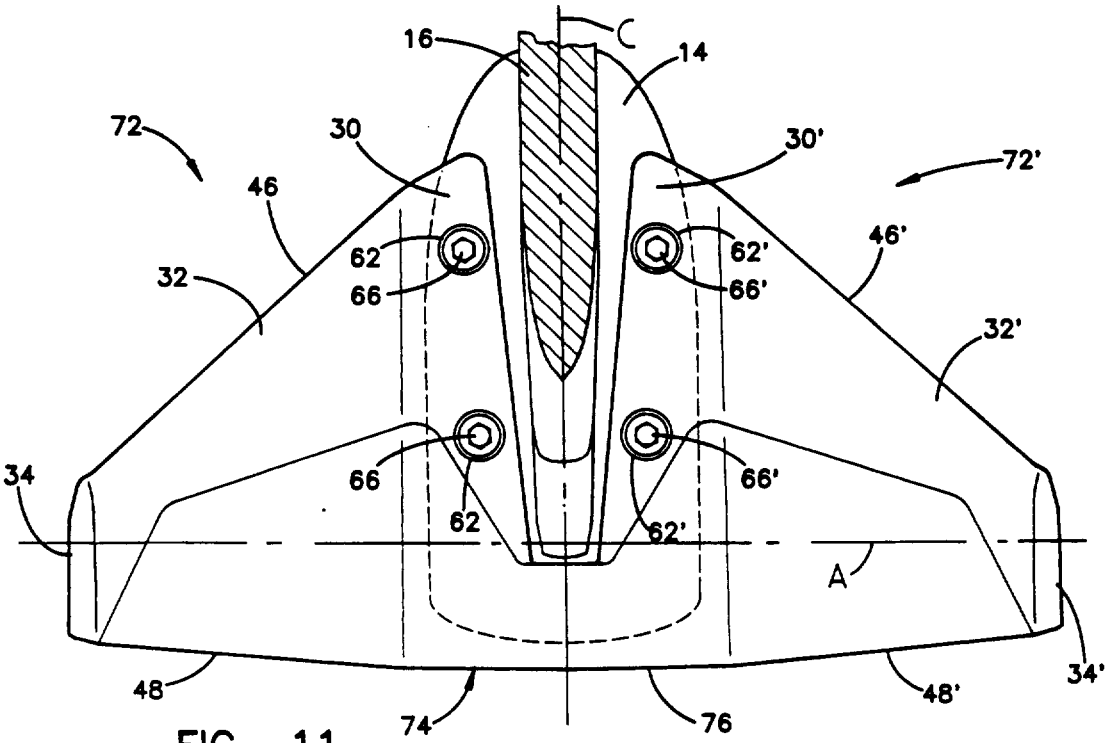
FIG. 11 is a top plan view of the hydrofoil assembly on the lower unit shown in FIGS. 9 and 10.
Figure 12:
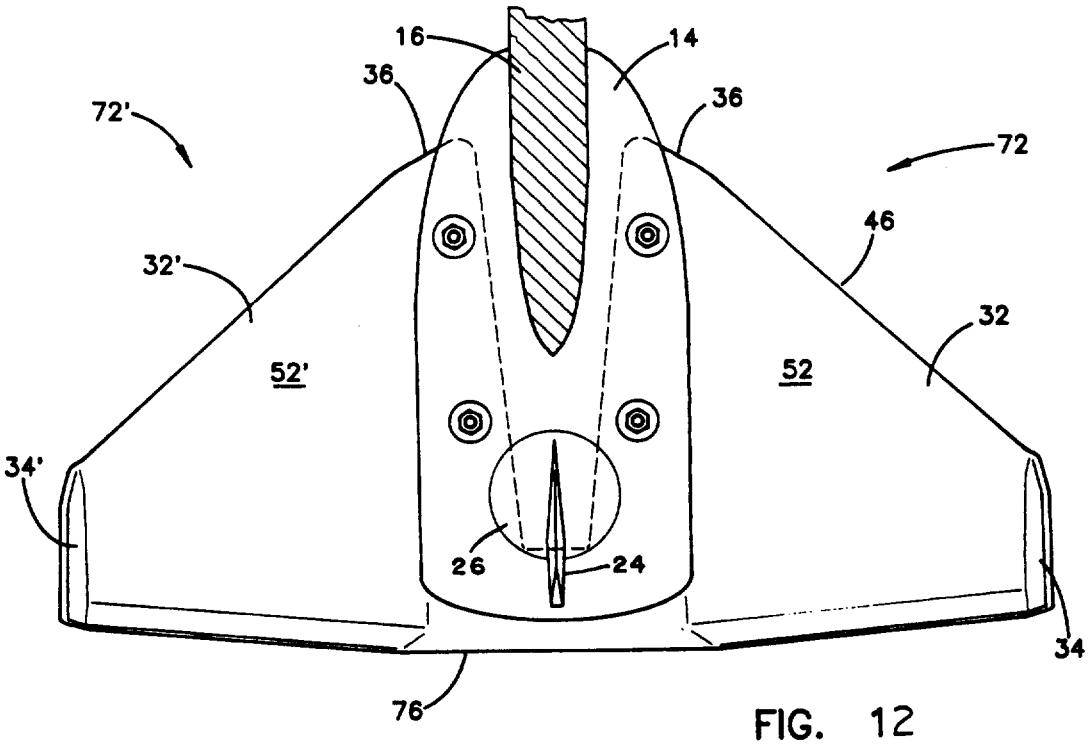
FIG. 12 is a bottom plan view of the hydrofoil assembly on the lower unit shown in FIGS. 9-11.

Each hydrofoil 12, 12' includes a mounting slot 58 which extends into the generally horizontal root segment 30 substantially parallel to the chord of the root segment as shown in FIG. 8. Slot 58 extends completely along the root segment from leading edge 36 to trailing edge 38 and is sized to snugly receive the plate 14 therein. At two spaced positions along the length of the root segment are securing apertures 60 which are recessed at 62 and 64 in the upper and lower surfaces 40, 42 of the root segment. Apertures 60 intersect with slot 58 and are adapted to receive fastening bolts 66 therethrough which engage the plate 14 to retain the hydrofoils 12, 12' in place on opposite sides of the plate 14 as shown in FIGS. 3 and 4. When mounted in this manner, wingtip fins 34 extend generally parallel to the fore and aft line C of the lower unit.

The angle of attack for the hydrofoils 12, 12' may be increased by trimming the lower unit by pivoting it from a vertical position toward the transom, i.e., toward the left in FIG. 2, called "low trim", or decreased when the lower unit is trimmed or pivoted away from the transom, i.e., toward the right in FIG. 2, called "high trim." At extreme low trim settings when the lower unit is pivoted closely adjacent the transom, the backwardly tipped angle of the transom, which can be as much at 13°-16° to the vertical, provides a significant angle of attack for the hydrofoil. High trim settings providing a negative angle of attack for the hydrofoils are typically used at higher speeds.

With the hydrofoils mounted as shown in FIGS. 1-8, as power is applied through propeller 20 of lower unit 16, the boat on which the lower unit with hydrofoils 12, 12' are mounted accelerates while the hydrofoils force the bow of the boat downwardly at a faster rate than for a boat and lower unit combination without hydrofoil assembly 10 or with certain prior known stabilizers. In addition, such acceleration performance is improved due to the combination of the wingtip fin and upwardly angled wing segments. The wingtip fins act to gather water which otherwise would pass outwardly away from the wing segment outer ends and force the water under the hydrofoil and along surfaces 52, 52' resulting in a tendency to increase lift which aids acceleration and forces the bow of the boat down more rapidly. At cruising or high speed settings, the V-shape of the hydrofoil assembly provided by the dihedral angle generally matches the V-shaped groove in the wake behind boats having V-shaped hulls such that water resistance and drag is reduced as compared to prior known horizontal stabilizers. At higher speed settings, when lower unit 16 is trimmed away from the transom as explained above, wing segments 32, 32' extend out of the water due to their positive upward dihedral angle thereby creating less wetted surface and lower drag which increases boat speed under planing, high power conditions. However, at both cruising and high speed power settings, enough stability is created by hydrofoil assembly 10 to prevent "porpoising" by significantly reducing pitching of the boat. Further, during acceleration, roll of the boat caused by the application of high power torque is reduced when the present hydrofoil assembly is used. At lower speeds, the lift provided by the hydrofoil assembly lowers the bow quickly and helps maintain the bow in a lowered condition thereby increasing visibility and improving safety for the watercraft operator.

With reference to FIGS. 9-15, a second embodiment 70 of the hydrofoil assembly is illustrated wherein like parts are indicated by like numerals. As with embodiment 10, hydrofoil assembly 70 is preferably molded from a rigid polypropylene sufficient to withstand the forces imposed on the lower unit in order to maintain the wing segments in position during operation. The principal difference between embodiments 10 and 70 is that the hydrofoils are joined together preferably during manufacture and are formed in one piece. Thus, assembly 70 includes hydrofoils 72, 72' each of which includes a root section 30, 30', a wing segment 32, 32' and a wingtip fin 34, 34' as in embodiment 10. However, in assembly 70, opposing hydrofoils 72, 72' are joined adjacent their trailing edges by a connecting segment 74 which extends laterally across and between the hydrofoils as shown in FIGS. 8-11. The shape and contour and substantially all features of the hydrofoil 72, 72' are the same as on separate hydrofoils 12, 12' except for the connection at the trailing edge via connecting segment 74 and a slightly different mounting structure. This includes a positive camber, convex upper or suction surface, generally planar lower or pressure surface, swept back leading edges, positive dihedral angle for the wing segments, rounded leading edges and blunt trailing edges, and downwardly angled lower trailing edge surface. Also, connecting segment 74 positions wing segments 32, 32' with the spanwise line A extending perpendicular to the fore and aft centerline C of the lower unit and wingtip fins 34, 34' generally parallel to that centerline as with assembly 10.

Figure 13:
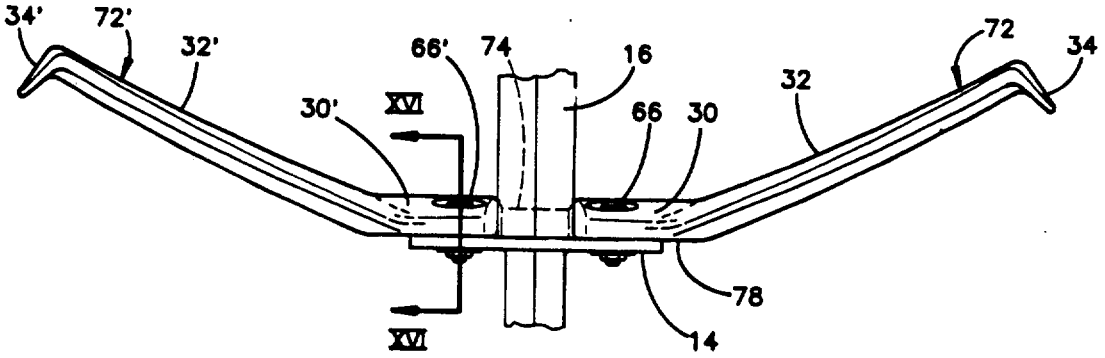
FIG. 13 is a front elevation of the hydrofoil assembly on the lower unit of FIGS. 9-12.
Figure 14:
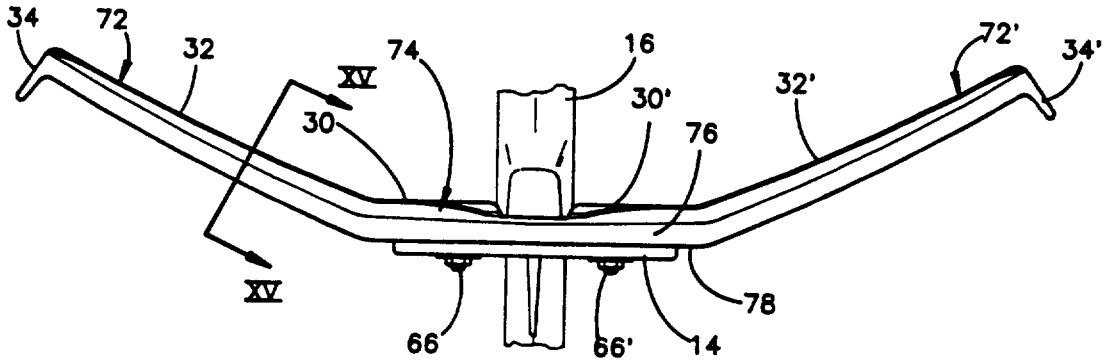
FIG. 14 is a rear elevation of the hydrofoil assembly on the lower unit shown in FIGS. 9-13.
Figure 15:
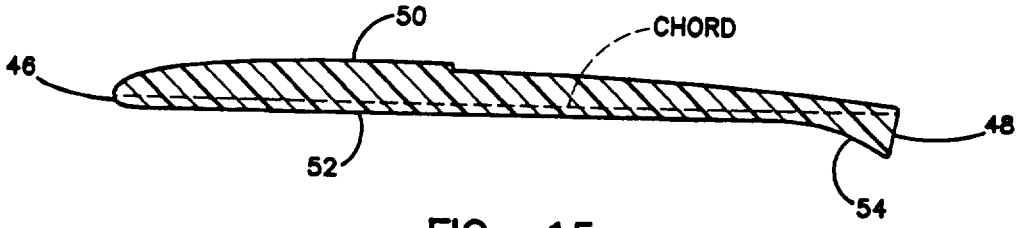
FIG. 15 is a section of the wing segment of one portion of the hydrofoil assembly taken along plane XV—XV of FIG. 14.

Connecting segment 74 is an extension of the trailing edge area of each hydrofoil 72, 72' and itself includes a blunt trailing edge 76 (FIGS. 11, 12 and 14) as well as a generally planar lower surface 78 corresponding to the lower surfaces of hydrofoil root sections 30, 30' as shown in FIGS. 13 and 14. Upper surface 75 of the connecting segment 74 corresponds to the shape and contour of the root segments adjacent the trailing edge.

Figure 16:
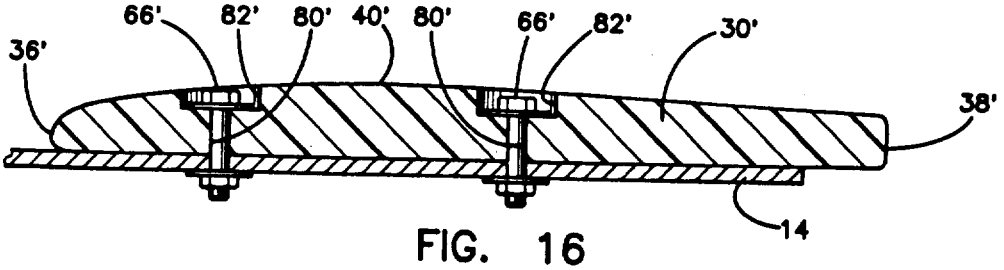
FIG. 16 is a sectional view of the root segment of one portion of the hydrofoil assembly taken along plane XVI—XVI of FIG. 13.

As will be understood from FIGS. 13, 14 and 16, instead of a mounting slot 58 as in assembly 10, assembly 70 is secured by securing apertures 80 which are recessed at 82 in the upper convex surface of root sections 30, 30' to receive securing bolts 66, 66' as shown in the drawings. Embodiment 70 is adapted to fit atop plate 14 and around the lower unit due to the spacing of hydrofoils 72, 72' with bolts 66, 66' holding the hydrofoil thereon as shown in FIG. 16. Operation and performance of the hydrofoil assembly is substantially as is shown and discussed above for embodiment 10.

Figure 17:
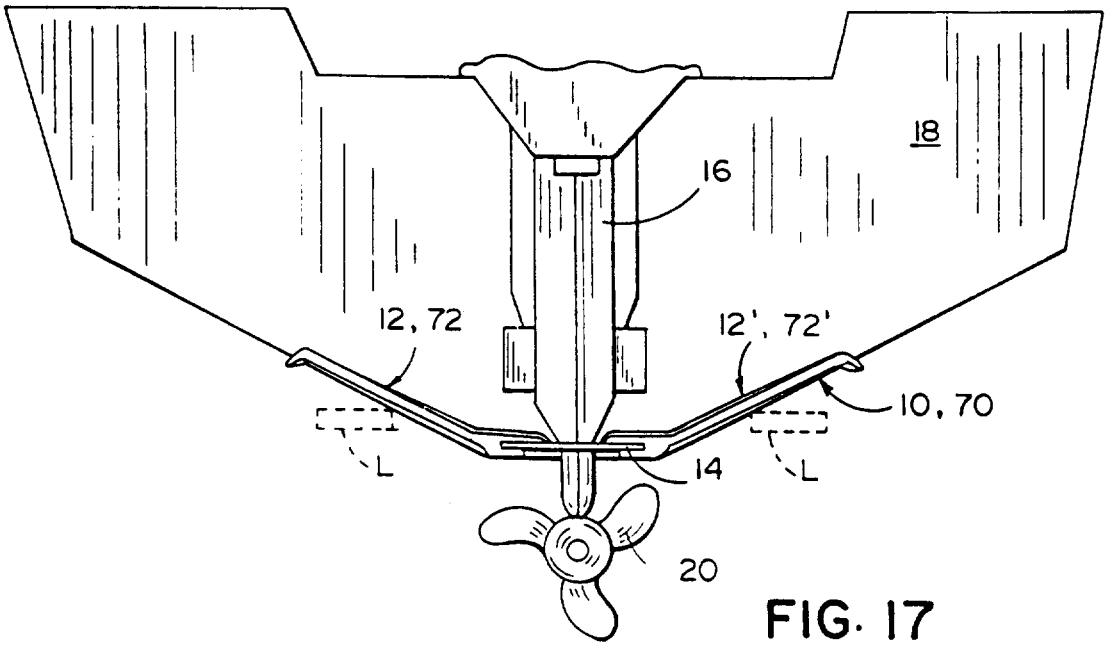
FIG. 17 is a fragmentary, rear elevation of the hydrofoil assembly mounted on the lower unit of a marine outboard engine on the transom of a conventional, V-hulled, sport runabout water craft.
Figure 18:
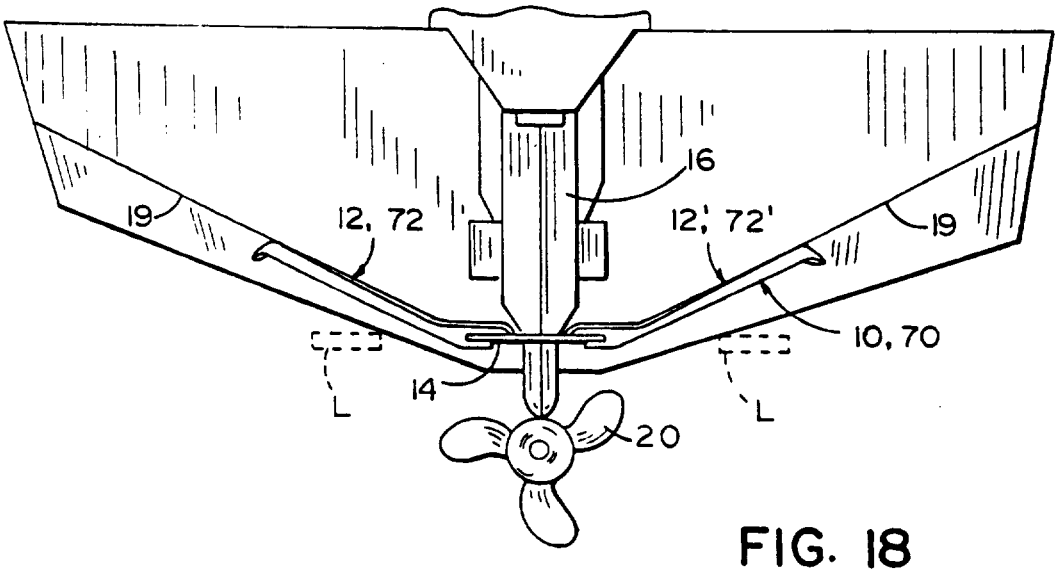
FIG. 18 is a rear elevation of the hydrofoil assembly mounted on the lower unit of a marine outboard engine mounted on the transom of a conventional, V-hulled, high speed "bass-type" fishing boat.

Referring now to FIGS. 17 and 18, installation of either hydrofoil assembly 10 or 70 on a lower unit 16 of a marine outboard engine or marine outdrive of an inboard/outboard unit is shown. In FIG. 17, a conventional sport runabout of the type having a V-shaped hull bottom is illustrated with the engine and its lower unit mounted on the transom 18. The preferred position of the engine for such type watercraft is with the anticavitation plate 14 substantially aligned with the lowermost surface of the V-shaped hull bottom such that the propeller 20 extends below the bottom of the boat as illustrated. In this position, when hydrofoil assembly 10 or 70 is mounted on plate 14, the positive dihedral angle of the hydrofoil assembly causes the wing segments to extend upwardly at generally the same angle as the hull bottom. Hence, the entire boat including lower unit 16 and hydrofoil assembly 10 or 70 thereon may be lifted from the rear by inserting the parallel lift forks L from a fork lift truck beneath the V-shaped hull bottom such that they engage the hull bottom without interference from or engagement with the wing segments of the hydrofoil assembly 10, 70. Thus, the boat may be launched and retrieved repeatedly without damage to either the hydrofoil assembly or the propulsion unit for the boat.

Likewise, on high speed fishing boats otherwise known as "bass boats", the preferred position for the engine and lower unit 16 on the transom 18 of such a boat is with the anticavitation plate 14 of the lower unit spaced above the lower most hull bottom surface as illustrated in FIG. 18. In this form, on such a boat, the wing segments of the hydrofoil assembly 10, 70 extend upwardly at an angle matched to the lower surface 19 of the rearwardly extending transom area above the lower most surface of the V-shaped hull bottom. Again, as in FIG. 16, the lift forks L from a fork lift truck may be inserted under the entire boat from the rear to engage the lower most hull bottom surface without interference from or damage to either the hydrofoil& assembly 10, 70 or the lower unit 16.

Accordingly, the present invention both improves low speed and acceleration performance and high speed operation of watercraft employing the hydrofoil assembly 10, 70 on their lower units at the rear of such craft. Similarly, interference with lift forks from fork lift trucks used to launch and retrieve boats equipped with such hydrofoil assemblies is prevented.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows.

1. A hydrofoil assembly for marine engines comprising:

a pair of hydrofoils, each hydrofoil including an upwardly angled wing segment having top and bottom surfaces and inner and outer ends, said wing segments extending upwardly to said outer end, a wingtip fin extending from said outer end of said wing segment, said wingtip fin having an inner and outer end, said inner end of said wingtip fin being affixed to the outer end of said upwardly angled wing segment, said outer end of said wingtip fin extending downwardly below the other end of the upwardly angled wing segment;

and mounting means for attaching said hydrofoil to an edge of an outwardly extending plate on the lower unit of a marine outboard engine/marine outdrive;

said pair of hydrofoils extending generally laterally outwardly in opposition to one another and generally transverse to the fore and aft lines of the lower unit when mounted thereon, each hydrofoil defining a positive upward dihedral angle of at least 15° with the horizontal thereby providing a shallow V-shape for the assembly when mounted on a lower unit;

whereby the performance and stability of a boat driven by the lower unit including said assembly is improved.

2. The assembly of claim 1 wherein each of said wing segments includes a swept back leading edge.

3. The assembly of claim 2 wherein each of said wing segments also includes a positive camber, a rounded leading edge, and a blunt trailing edge.

4. The assembly of claim 3 wherein the bottom surface of each of said wing segments adjacent said trailing edge extends downwardly at an angle to the remainder of said bottom surface.

5. The assembly of claim 3 wherein said leading and trailing edges of each of said wing segments converge toward said outer end such that each of said wing segments is tapered outwardly; each hydrofoil section of each wing segment having a top surface which is convex and a bottom surface which is rectilinear.

6. A hydrofoil assembly for marine engines comprising:

a pair of hydrofoils, each hydrofoil including an upwardly angled wing segment having top and bottom surfaces and inner and outer ends, a wingtip fin extending downwardly from said outer end of said wing segment, and mounting means for attaching said hydrofoil to an edge of an outwardly extending plate on the lower unit of a marine outboard engine/marine outdrive;

said pair of hydrofoils extending generally laterally outwardly in opposition to one another and generally transverse to the fore and aft line of the lower unit when mounted thereon, each hydrofoil defining a positive, upward dihedral angle with the horizontal thereby providing a shallow V-shape for the assembly when mounted on a lower unit;

each of said wing segments including a swept back, rounded leading edge, a positive camber, and a blunt trailing edge;

said leading and trailing edges of each of said wing segments converging toward said outer end such that each of said wing segments is tapered outwardly;

each of said wing segments including a plurality of hydrofoil sections, each of said sections having a top surface which is convex, a bottom surface which is rectilinear, and a chord extending between said leading and trailing edges; said wingtip fin being generally planar and lying generally perpendicular to a line extending in the spanwise direction through each of the chords of the hydrofoil sections and generally parallel to the chord of the innermost section of said wing segment;

whereby the performance and stability of a boat driven by the lower unit including said assembly is improved.

7. The assembly of claim 6 wherein said wingtip fin has a leading edge which curves rearwardly toward the bottom thereof.

8. The assembly of claim 6 wherein each of said wingtip fins extends along the full length of its respective wing segment outer end.

9. The assembly of claim 3 wherein each wing segment extends upwardly with respect to the horizontal at a positive dihedral angle within the range of between 15° and 25°.

10. A hydrofoil assembly for marine engines comprising:

a pair of hydrofoils, each hydrofoil including an upwardly angled wing segment having top and bottom surfaces and inner and outer ends, a wingtip fin extending downwardly from said outer end of said wing segment, and mounting means for attaching said hydrofoil to an edge of an outwardly extending plate on the lower unit of a marine outboard engine/marine outdrive;

said pair of hydrofoils extending generally laterally outwardly in opposition to one another and generally transverse to the fore and aft line of the lower unit when mounted thereon, each hydrofoil defining a positive, upward dihedral angle with the horizontal thereby providing a shallow V-shape for the assembly when mounted on a lower unit;

each of said wing segments including a swept back leading edge and a root segment at said inner end, each root segment extending generally horizontally such that it extends at an angle to its wing segment and includes a swept back leading edge; said leading edge of said wing segment being swept back at a greater angle than said leading edge of said root segment;

whereby the performance and stability of a boat driven by the lower unit including said assembly is improved.

11. The assembly of claim 1 wherein each wing segment extends upwardly with respect to the horizontal at a positive dihedral angle within the range of between 15° and 25°.

12. A hydrofoil assembly for marine engines comprising:

a pair of hydrofoils, each hydrofoil including an upwardly angled wing segment having top and bottom surfaces and inner and outer ends, a wingtip fin extending downwardly from said outer end of said wing segment, and mounting means for attaching said hydrofoil to an edge of an outwardly extending plate on the lower unit of a marine outboard engine/marine outdrive;

said pair of hydrofoils extending generally laterally outwardly in opposition to one another and generally transverse to the fore and aft line of the lower unit when mounted thereon, each hydrofoil defining a positive, upward dihedral angle with the horizontal thereby providing a shallow V-shape for the assembly when mounted on a lower unit;

each of said wing segments including a plurality of hydrofoil sections, each of said sections having a chord extending between said leading and trailing edges; said wingtip fin being generally planar and lying generally perpendicular to a line extending in the spanwise direction of said wing segments through each of the chords of the hydrofoil sections and generally parallel to the chord of the innermost section of said wing segment;

whereby the performance and stability of a boat driven by the lower unit including said assembly is improved.

13. The assembly of claim 1 wherein each of said wing segments includes a root segment at said inner end, each root segment extending generally horizontally such that it extends at an angle to its wing segment and includes a swept back leading edge.

14. The assembly of claim 10 wherein each of said root segments has a positive camber with a convex top surface and a generally planar bottom surface.

15. The assembly of claim 10 wherein each of said root segments has a rounded leading edge and a blunt trailing edge.

16. The assembly of claim 10 wherein each of said root segments includes a chord; said mounting means including a slot extending generally parallel to said chord of and int each of said root segments for receiving the outwardly extending plate of the lower unit and at least one aperture extending through each of said root segments for receiving a securing fastener adapted to pass through the plate on the lower unit, said aperture intersecting said slot.

17. The assembly of claim 16 wherein the bottom surface of said root section is partially cutaway to fit around portions of the lower unit.

18. The assembly of claim 10 wherein said root segments each include an inner edge; said mounting means including a connecting segment joining said pair of hydrofoils together in spaced relationship adjacent said trailing edges of said root segments; said assembly including a space intermediate said leading edges and inner ends of said root segments.

19. The assembly of claim 10 wherein said hydrofoils are separate and adapted for separate installation on opposite sides of the lower unit to form said assembly.

20. The assembly of claim 1 wherein said mounting means include a connecting segment joining said pair of hydrofoils together in spaced relationship adjacent said trailing edges thereof; said hydrofoils including a space therebetween adapted to receive a portion of a lower unit therebetween.

21. The assembly of claim 1 wherein said hydrofoils are separate and adapted for separate installation on opposite sides of the lower unit to form said assembly.

22. A hydrofoil assembly for the lower unit of a marine outdrive/outboard engine having an outwardly extending anti-cavity plate comprising:

a pair of hydrofoils each having upwardly angled wing segments each having top and bottom surfaces and inner and outer ends, said wing segment each extending upwardly to its outer end;

a wingtip fin extending from each of said outer ends of said wing segments, said wingtip fin having an inner and outer end, said inner end of said wingtip fin being affixed to the outer end of said upwardly angled wing segment, said outer end of said wingtip fin extending downwardly below the outer end of the upwardly angled wing segment; and mounting means for attaching said hydrofoils to an edge of said outwardly extending plate on the lower unit of a marine outboard engine/marine outdrive;

said hydrofoils adapted to extend laterally outwardly and generally transverse to the fore and aft line of the lower unit when mounted thereon, and defining a positive, upward dihedral angle of at least 15° with the horizontal when so mounted.

23. The assembly of claim 22 wherein each wing segment includes a swept back leading edge.

24. The assembly of claim 32 wherein each wing segment also includes a positive camber, a rounded leading edge, and a blunt trailing edge.

25. The assembly of claim 24 wherein the bottom surface of each wing segment adjacent said trailing edge extends downwardly at an angle to the remainder of said bottom surface.

26. The assembly of claim 24 wherein said leading and trailing edges of each wing segment converge toward said outer end such that each wing segment is tapered outwardly; each hydrofoil section of each wing segment having a top surface which is convex and a bottom surface which is rectilinear.

27. A hydrofoil for the lower unit of a marine outdrive/outboard engine comprising:

an upwardly angled wing segment having top and bottom surfaces and inner and outer ends;

a wingtip fin extending downwardly from said outer end of said wing segment;

mounting means for attaching said hydrofoil to an edge of an outwardly extending plate on the lower unit of a marine outboard engine/marine outdrive;

said hydrofoil adapted to extend laterally outwardly and generally transverse to the fore and aft line of the lower unit when mounted thereon, and defining a positive, upward dihedral angle with the horizontal when so mounted;

said wing segment including a swept back, rounded leading edge, a positive camber, and a blunt trailing edge;

said leading and trailing edges of said wing segment converging toward said outer end such that said wing segment is tapered outwardly;

said wing segment including a plurality of hydrofoil sections, each of said sections having a top surface which is convex and a bottom surface which is rectilinear, and a chord extending between said leading and trailing edges; said wingtip fin being generally planar and lying generally perpendicular to a line extending in the spanwise direction of said wing segment through each of the chords of the hydrofoil sections and generally parallel to the chord of the innermost section of said wing segment.

28. The assembly of claim 27 wherein said wingtip fin has a leading edge which curves rearwardly toward the bottom thereof.

29. The assembly of claim 27 wherein said wingtip fin extends along the full length of its respective wing segment outer end.

30. The assembly of claim 24 wherein each wing segment extends upwardly with respect to the horizontal at a positive dihedral angle within the range of between 15° and 25°.

31. A hydrofoil for the lower unit of a marine outdrive/outboard engine comprising:

an upwardly angled wing segment having top and bottom surfaces and inner and outer ends;

a wingtip fin extending downwardly from said outer end of said wing segment;

mounting means for attaching said hydrofoil to an edge of an outwardly extending plate on the lower unit of a marine outboard engine/marine outdrive;

said hydrofoil adapted to extend laterally outwardly and generally transverse to the fore and aft line of the lower unit when mounted thereon, and defining a positive, upward dihedral angle with the horizontal when so mounted;

said wing segment including a swept back leading edge and a root segment at said inner end, said root segment extending generally horizontally such that it extends at an angle to said wing segment and includes a swept back leading edge; said leading edge of said wing segment being swept back at a greater angle than said leading edge of said root segment.

32. The assembly of claim 22 wherein each wing segment extends upwardly with respect to the horizontal at a positive dihedral angle within the range of between 15° and 25°.

33. A hydrofoil for the lower unit of a marine outdrive/outboard engine comprising:

an upwardly angled wing segment having top and bottom surfaces, leading and trailing edges, and inner and outer ends;

a wingtip fin extending downwardly from said outer end of said wing segment;

mounting means for attaching said hydrofoil to an edge of an outwardly extending plate on the lower unit of a marine outboard engine/marine outdrive;

said hydrofoil adapted to extend laterally outwardly and generally transverse to the fore and aft line of the lower unit when mounted thereon, and defining a positive, upward dihedral angle with the horizontal when so mounted;

said wing segment including a plurality of hydrofoil sections, each of said sections having a chord extending between said leading and trailing edges; said wingtip fin being generally planar and lying generally perpendicular to a line extending in the spanwise direction of said wing segment through each of the chords of the hydrofoil sections and generally parallel to the chord of the innermost section of said wing segment.

34. The assembly of claim 22 wherein each wing segment includes a root segment at said inner end, said root segment extending generally horizontally such that it extends at an angle to said wing segment and includes a swept back leading edge.

35. The assembly of claim 31 wherein said root segment has a positive camber with a convex top surface and a generally planar bottom surface.

36. The assembly of claim 31 wherein said root segment has a rounded leading edge and a blunt trailing edge.

37. The assembly of claim 31 wherein said root segment includes a chord; said mounting means including a slot extending generally parallel to said chord of and into said root segment for receiving the outwardly extending plate of the lower unit and at least one aperture extending through said root segment for receiving a securing fastener adapted to pass through the plate on the lower unit, said aperture intersecting said slot.

38. The assembly of claim 37 wherein the bottom surface of said root section is partially cutaway to fit around portions of the lower unit.

39. In an assembly of a boat having a transom and a generally V-shaped hull bottom extending at a predetermined angle to the horizontal, a marine outboard engine/marine outdrive having a lower unit including a propeller at its lower end and an anti-cavity plate located above said propeller said outdrive being mounted on said transom and a pair of wing-like hydrofoils mounted on said outboard engine/marine outdrive lower unit, said hydrofoils projecting laterally outwardly of said engine/outdrive lower unit adjacent and to the rear of said transom, the improvement comprising:

said pair of hydrofoils being secured to either side of said engine/outdrive lower unit above said propeller, each hydrofoil including an upwardly angled wing segment, said wing segments together forming a V-shape on said engine/outdrive; said wing segments each extending upwardly at an angle generally at least equal to said angle of said hull bottom with substantial portions of said V-shape of said hydrofoils located above the lowermost surface of the V-shaped hull bottom whereby the forks of a fork lift truck useful to lift said boat may extend from the rear below such portions and engage said hull bottom from the rear without interference from said hydrofoils.

40. The assembly of claim 39 wherein said engine/-outdrive lower unit is mounted on said transom in a position such that said hydrofoils are positioned approximately flush with said hull bottom.

41. The assembly of claim 39 wherein said engine/-outdrive lower unit is mounted on said transom in a position such that said hydrofoils are positioned above said hull bottom.

42. The assembly of claim 39 wherein said hydrofoil wing segments each have top and bottom surfaces and inner and outer ends; each hydrofoil also including a wingtip fin extending downwardly from said outer end of said wing segment, and mounting means for attaching said hydrofoil to an edge of said anti-cavity plate on said engine/outdrive lower unit.

43. The assembly of claim 42 wherein each of said wing segments includes a swept back leading edge.

44. The assembly of claim 43 wherein each of said wing segments also includes a positive camber, a rounded leading edge, and a blunt trailing edge.

45. The assembly of claim 44 wherein each wing segment extends upwardly with respect to the horizontal at a positive dihedral angle within the range of between 15° and 25°.

46. The assembly of claim 42 wherein each of said wing segments includes a root segment at said inner end, each root segment including a chord; said mounting means including a slot extending generally parallel to said chord of and into each of said root segments receiving said anti-cavity plate of said lower unit and at least one aperture extending through each of said root segments for receiving a securing fastener which passes through the plate on the lower unit, said aperture intersecting said slot.

47. In an assembly of a boat having a transom and a generally V-shaped hull bottom extending at a predetermined angle to the horizontal, a marine outboard engine/marine outdrive having a lower unit including a propeller at its lower end and mounted on said transom, and a pair of wing-like hydrofoils mounted on said outboard engine/marine outdrive lower unit, said hydrofoils projecting laterally outwardly of said engine/-outdrive lower unit adjacent and to the rear of said transom, the improvement comprising:

said pair of hydrofoils being secured to either side of said engine/outdrive lower unit above said propeller, each hydrofoil including an upwardly angled wing segment, said wing segments together forming a V-shape on said engine/outdrive; said wing segments each extending upwardly at an angle generally at least equal to said angle of said hull bottom with said V-shape of said hydrofoils generally matching said V-shape of said hull bottom whereby the forks of a fork lift truck useful to lift said boat may engage said hull bottom from the rear without interference from said hydrofoils;

each of said wing segments including leading and trailing edges, an outer end, a wingtip fin extending downwardly from said outer end, and a plurality of hydrofoil sections, each of said sections having a chord extending between said leading and trailing edges; said wingtip fin being generally planar and lying generally perpendicular to a line extending in the spanwise direction of said wing segments through each of the chords of the hydrofoil sections and generally parallel to the chord of the innermost section of said wing segment.

* * * * *

UNITED STATES PATENT AND TRADEMARK OFFICE

CERTIFICATE OF CORRECTION

PATENT NO. : 5,138,966

DATED : August 18, 1992

INVENTOR(S) : Warwick M. Whitley, II

It is certified that error appears in the above-identified patent and that said Letters Patent is hereby corrected as shown below:

Column 2, line 55
"unit, tne" should be --unit, the--.

Column 3, line 10
"of tne" should be --of the--.

Column 4, line 33
"on tne" should be --on the--.

Column 4, line 39
"34 or" should be --34 at--.

Column 7, line 41
"hydrofoil&" should be --hydrofoil--.

Column 8, line 3
"other end" should be --outer end--.

Column 10, line 21
"and int" should be --and into--.

UNITED STATES PATENT AND TRADEMARK OFFICE

CERTIFICATE OF CORRECTION

PATENT NO. : 5,138,966

DATED : August 18, 1992

INVENTOR(S) : Warwick M. Whitley, II

It is certified that error appears in the above-identified patent and that said Letters Patent is hereby corrected as shown below:

Column 10, line 54
"segment" should be --segments--.

Column 11, line 6
"claim 32 should be --claim 23--.

Signed and Sealed this

Second Day of November, 1993

Bruce Lehman

*Attest:*

BRUCE LEHMAN

*Attesting Officer*

*Commissioner of Patents and Trademarks*